US006110080A

United States Patent [19]

Niv

[11] Patent Number: 6,110,080

[45] Date of Patent: Aug. 29, 2000

[54] THERAPEUTIC HEADPIECE

[76] Inventor: Tsahi Niv, 14 Brandon Ave., Livingston, N.J. 07039

[21] Appl. No.: 09/174,355

[22] Filed: Oct. 15, 1998

[51] Int. Cl.[7] ..... A63B 21/065; A63B 23/025

[52] U.S. Cl. ..... 482/105; 482/10; 482/93; 601/39; 2/171.2

[58] Field of Search ..... 482/10, 11, 92, 482/93, 105; 601/39, 79; 607/109, 110, 139; 2/171.2, 209.13

[56] References Cited

U.S. PATENT DOCUMENTS

| | | | |
|---|---|---|---|
| D. 160,404 | 10/1950 | Levine | 2/209.13 |
| 500,686 | 7/1893 | Corker | 482/10 |
| 3,114,982 | 12/1963 | McGowan | 482/105 |
| 3,330,560 | 7/1967 | Higdon | 482/93 |
| 4,312,076 | 1/1982 | Gamm | 2/209.13 |
| 4,632,389 | 12/1986 | Moss | 482/105 |
| 4,953,856 | 9/1990 | Fox, III | 482/105 |
| 4,988,093 | 1/1991 | Forrest, Sr. et al. | 482/10 |
| 5,117,510 | 6/1992 | Broussard et al. | 2/209.13 |
| 5,386,592 | 2/1995 | Checkeroski | 2/209.13 |

FOREIGN PATENT DOCUMENTS

| | | | |
|---|---|---|---|
| 1227211 | 4/1986 | U.S.S.R. | 482/10 |

*Primary Examiner*—Glenn E. Richman
*Assistant Examiner*—Victor Hwang

[57] ABSTRACT

A new therapeutic headpiece for applying a mechanic load to a cervical and upper thoracic spine to promote bone development. The inventive device includes a cap portion dimensioned for receiving a user's head therein. A plurality of sleeves are secured to the cap portion. Each of the sleeves have open opposed ends. The open opposed ends receive weights therethrough for positioning within the sleeves. At least one cover member is provided which is removably attached to the cap portion and has a plurality of tubular sleeves for receiving weights to provide additional weight to the cap portion.

8 Claims, 3 Drawing Sheets

THERAPEUTIC HEADPIECE

BACKGROUND OF THE INVENTION

1. Field of the Invention

The present invention relates to physical conditioning apparatuses and more particularly pertains to a new therapeutic headpiece for loading the cervical and upper thoracic spine to promote bone remodeling, increase structural stability, and prevent resorption of minerals from the bone.

2. Description of the Prior Art

The use of physical conditioning apparatuses is known in the prior art. More specifically, physical conditioning apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art physical conditioning apparatuses include U.S. Pat. No. 4,168,060 to Hohenfeldt; U.S. Pat. No. 4,339,124 to Vogler; U.S. Pat. No. 5,336,139 to Miller; U.S. Pat. No. 4,537,393 to Kusch; U.S. Pat. No. 3,866,910 to Herring; and U.S. Pat. No. Des. 338,544 to Scheinbaum.

While these devices fulfill their respective, particular objectives and requirements, the aforementioned patents do not disclose a new therapeutic headpiece. The inventive device includes a cap portion dimensioned for receiving a user's head therein. A plurality of sleeves are secured to the cap portion. Each of the sleeves have open opposed ends. The open opposed ends receive weights therethrough for positioning within the sleeves.

In these respects, the therapeutic headpiece according to the present invention substantially departs from the conventional concepts and designs of the prior art, and in so doing provides an apparatus primarily developed for the purpose of applying a mechanic load to the cervical and upper thoracic spine to achieve and promote bone development and laying down of important minerals to maintain stronger, denser, and healthier bones as well as to increase postural awareness and cervical subscipital muscle balance.

SUMMARY OF THE INVENTION

In view of the foregoing disadvantages inherent in the known types of physical conditioning apparatuses now present in the prior art, the present invention provides a new therapeutic headpiece construction wherein the same can be utilized for applying a mechanic load to an upper thoracic spine to achieve bone development.

The general purpose of the present invention, which will be described subsequently in greater detail, is to provide a new therapeutic headpiece apparatus and method which has many of the advantages of the physical conditioning apparatuses mentioned heretofore and many novel features that result in a new therapeutic headpiece which is not anticipated, rendered obvious, suggested, or even implied by any of the prior art physical conditioning apparatuses, either alone or in any combination thereof.

To attain this, the present invention generally comprises a cap portion dimensioned for receiving a user's head therein. The cap portion includes an open lower end for receiving the user's head and a curved upper portion for contouring to the user's head. The curved upper portion includes a forward section, a rearward section, and a pair of opposed side sections. Two pairs of tubular sleeves are secured to each of the opposed side sections of the curved upper portion of the cap portion. The tubular sleeves are contoured to correspond with the curved upper portion and the head of the user. The tubular sleeves are latitudinally oriented. Each of the tubular sleeves have open opposed ends. The open opposed ends receive tubular weights therethrough for positioning within the tubular sleeves. A pair of pockets are disposed on the forward section and the rearward section of the curved upper portion of the cap portion. Each of the pockets have an open upper end for receiving a weight therein. The open upper ends have a flap closably disposed thereover.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new therapeutic headpiece apparatus and method which has many of the advantages of the physical conditioning apparatuses mentioned heretofore and many novel features that result in a new therapeutic headpiece which is not anticipated, rendered obvious, suggested, or even implied by any of the prior art physical conditioning apparatuses, either alone or in any combination thereof.

It is another object of the present invention to provide a new therapeutic headpiece which may be easily and efficiently manufactured and marketed.

It is a further object of the present invention to provide a new therapeutic headpiece which is of a durable and reliable construction.

An even further object of the present invention is to provide a new therapeutic headpiece which is susceptible of a low cost of manufacture with regard to both materials and labor, and which accordingly is then susceptible of low prices of sale to the consuming public, thereby making such therapeutic headpiece economically available to the buying public.

Still yet another object of the present invention is to provide a new therapeutic headpiece which provides in the apparatuses and methods of the prior art some of the advantages thereof, while simultaneously overcoming some of the disadvantages normally associated therewith.

Still another object of the present invention is to provide a new therapeutic headpiece for applying a mechanic load to an upper thoracic spine to promote designed bone development.

Yet another object of the present invention is to provide a new therapeutic headpiece which includes a cap portion dimensioned for receiving a user's head therein. A plurality of sleeves are secured to the cap portion. Each of the sleeves have open opposed ends. The open opposed ends receive weights therethrough for positioning within the sleeves.

Still yet another object of the present invention is to provide a new therapeutic headpiece for proprioceptive training of the head and neck.

Even still another object of the present invention is to provide a new therapeutic headpiece that improves muscle balance and functional performance to promote proper head and neck anatomical alingment.

Even still yet another object of the present invention is to provide a new therapeutic headpiece for postural training and to improve postural awareness throughout the head, neck, and upper back.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
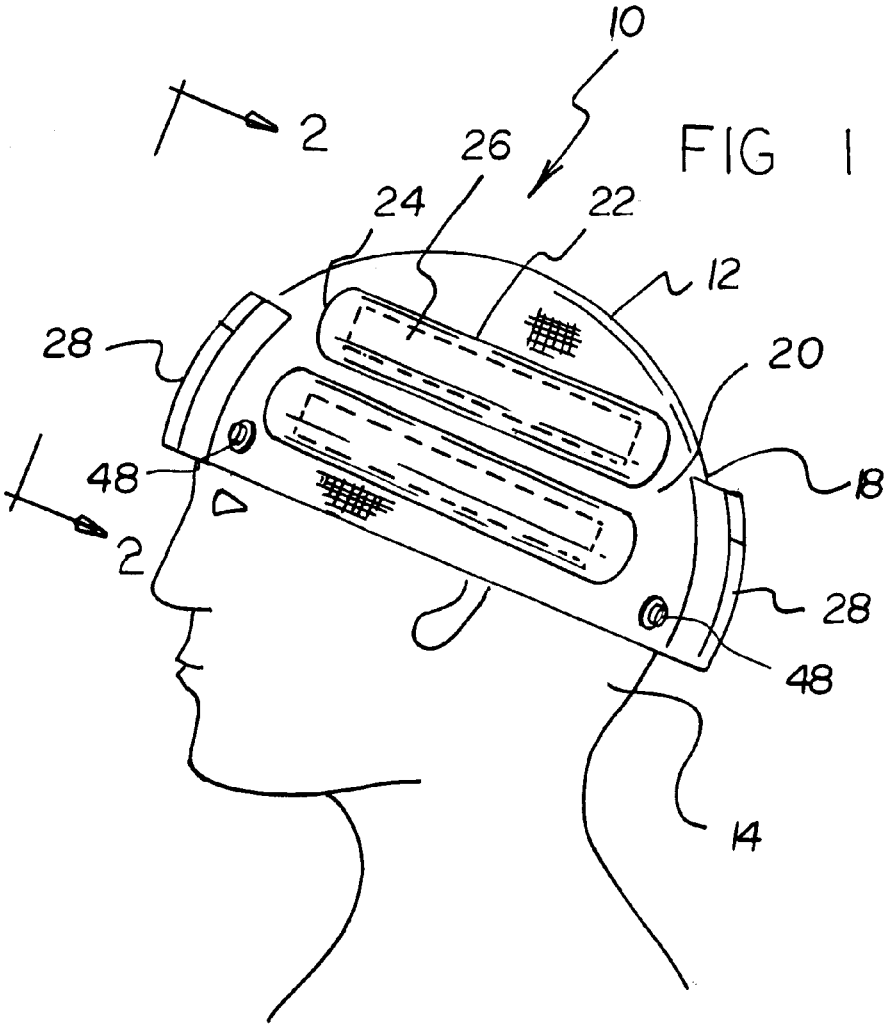
FIG. 1 is a side view of a new therapeutic headpiece according to the present invention.
Figure 2:
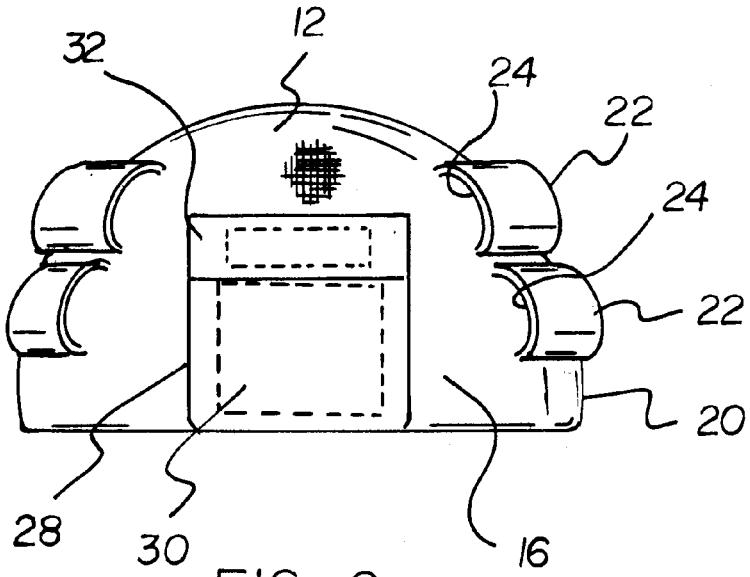
FIG. 2 is a front view of the present invention as taken along line 2—2 of FIG. 1.
Figure 3:
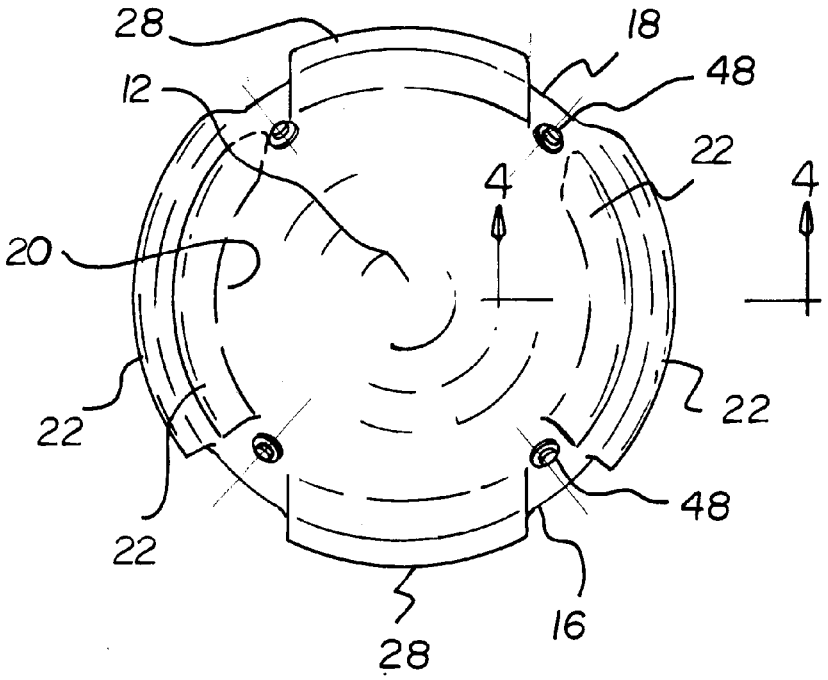
FIG. 3 is a top plan view of the present invention.
Figure 4:
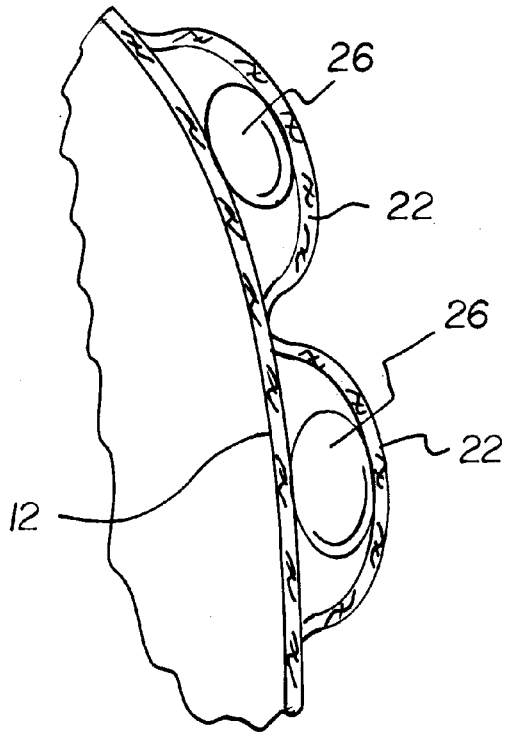
FIG. 4 is a cross-sectional view of the present invention as taken along line 4—4 of FIG. 3.

With reference now to the drawings, and in particular to FIGS. 1 through 6 thereof, a new therapeutic headpiece embodying the principles and concepts of the present invention and generally designated by the reference numeral 10 will be described.

As best illustrated in FIGS. 1 through 6, the therapeutic headpiece 10 comprises a cap portion 12 dimensioned for receiving a user's head 14 therein. The cap portion 12 includes an open lower end for receiving the user's head 14 and a curved upper portion for contouring to the user's head 14. The curved upper portion includes a forward section 16, a rearward section 18, and a pair of opposed side sections 20. The cap portion 12 is preferably made of a double layered fabric material that is stretchable to conform to the user's head 14.

Two pairs of tubular sleeves 22 are secured to each of the opposed side sections 20 of the curved upper portion of the cap portion 12. The tubular sleeves 22 are contoured to correspond with the curved upper portion and the head 14 of the user. The tubular sleeves 22 are latitudinally oriented. Each of the tubular sleeves 22 has open opposed ends 24. The open opposed ends 24 receive tubular weights 26 therethrough for positioning within the tubular sleeves 22. The sleeves 22 could be constructed of different diameters or organized in varying densities or distances between one sleeve 22 to another. The weights 26 could be increased or decreased to accommodate the user.

A pair of pockets 28 are disposed on the forward section 16 and the rearward section 18 of the curved upper portion of the cap portion 12. Each of the pockets 28 has an open upper end for receiving a weight 30 therein. The open upper ends have a flap 32 closably disposed thereover. The flaps 32 would be provided with a hook and loop closure to facilitate the closing of the open upper end of the pockets 28.

Figure 5:
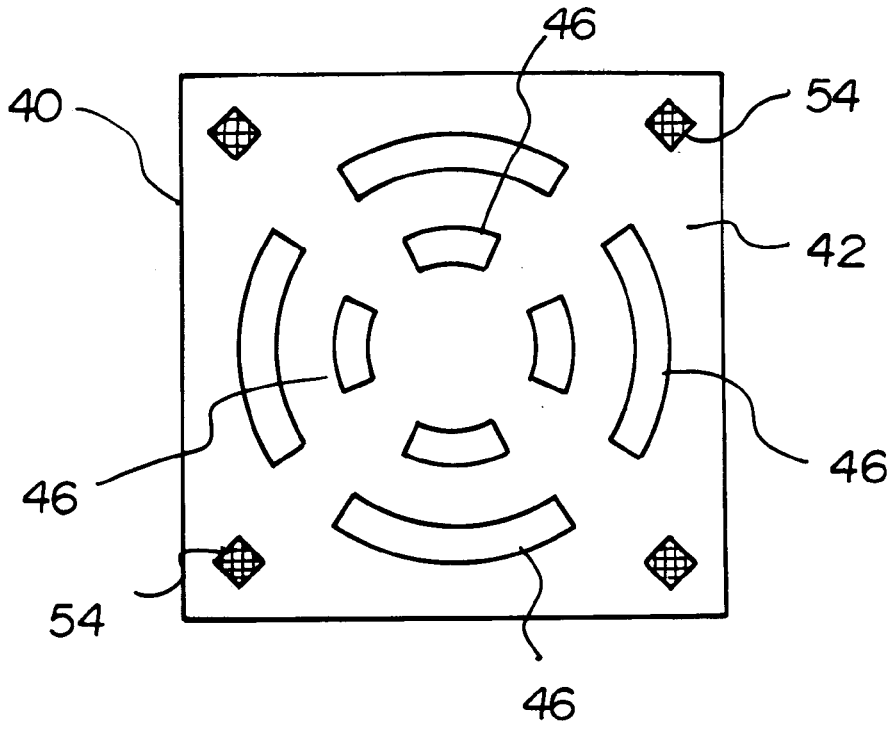
FIG. 5 is a top plan view of the cover member of the present invention.
Figure 6:
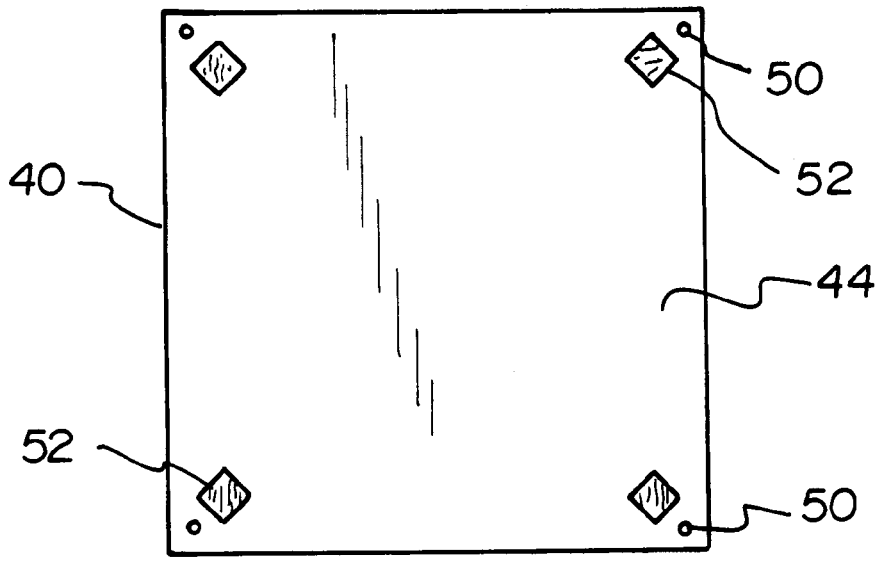
FIG. 6 is a bottom plan view of the cover member of the present invention.

Preferably, a cover member 40 may rest on the cap portion 12 to provide more weight. The added weight may be needed as a progression of an exercise program or to develop increased endurance. As shown in FIGS. 5 and 6, the cover member 40 has an upper surface 42, and a lower surface 44 that is dimensioned for resting on the curved upper portion of the cap portion 12. The upper surface 42 of the cover member 40 has a plurality of circularly arranged tubular sleeves 46 thereon which receive generally tubular weights (not shown) therein. Preferably, the upper portion of the cap portion 12 has a plurality of first fasteners 48 coupled to it towards the open lower end of the cap portion 12. The cover member 40 has a plurality of second fasteners 50 that couple with the first fasteners 48 of the cap portion 12. Also preferably, the cover member 40 is generally rectangular in shape. In such an embodiment, the second fasteners 50 are positioned towards each corner of the cover member 40. Ideally, the first and second fasteners 48,50 comprise snaps.

Ideally, a plurality of cover members 40 are provided. The lower surface 44 of each of the cover members 40 is adapted for resting on the upper surface 42 of another cover member such that one or more cover members may be stacked on top of another on the cap portion 12. Preferably, in such an embodiment, each of the lower surfaces 44 of the cover members 40 has a plurality of third fasteners 52 that are ideally positioned towards each corner of the cover member 40 inwardly of the second fasteners 50. Each of upper surfaces 42 of the cover members 40 has a plurality of fourth fasteners 54 that are ideally positioned towards each corner of the cover member 40. The fourth fasteners 54 of one cover member 40 couple with the third fasteners 52 of another cover member 40. Ideally, the third and fourth fasteners 52,54 comprise hooks and loops fasteners.

In use, the present invention would fulfill the need for a physical therapy device that would apply weights, stress, and/or mechanical loads to the head 14 in an effort to promote bone development in the neck and upper back. The weights of the weights 26 could be varied or either of the tubular sleeves 22 or the pair of pockets 28 could be left empty any time to vary the weight resistance on the user to help strengthen particular areas of the bone.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new therapeutic headpiece for applying a mechanic load to an upper thoracic spine to achieve bone development comprising, in combination:

a cap portion dimensioned for receiving a user's head therein, the cap portion including an open lower end for receiving the user's head and a curved upper portion for contouring to the user's head, the curved upper portion including a forward section, a rearward section, and a pair of opposed side sections;

two pairs of tubular sleeves secured to each of the opposed side sections of the curved upper portion of the cap portion, the tubular sleeves being contoured to correspond with the curved upper portion and the head of the user, the tubular sleeves being latitudinally oriented, each of the tubular sleeves having open opposed ends, the open opposed ends for receiving generally tubular weights therethrough for positioning within the tubular sleeves;

a pair of pockets disposed on the forward section and the rearward section of the curved upper portion of the cap portion, each of the pockets having an open upper end for receiving a weight therein, the open upper ends having a flap closably disposed thereover;

a plurality of generally rectangular cover members, each of the cover members having an upper surface, a plurality of corners, and a lower surface being dimensioned for resting on the curved upper portion of the cap portion, the lower surface of each of the cover members being adapted for resting on the upper surface of another cover member, each of the upper surfaces of the cover members having a plurality of circularly arranged tubular sleeves thereon for receiving generally tubular weights therein;

the upper portion of the cap portion having a plurality of first fasteners being coupled thereto towards the open lower end, each of the fasteners being positioned between a tubular sleeve and a pocket, wherein the first fasteners comprise snaps;

each of the cover members having a plurality of second fasteners being positioned towards each corner of the cover members, the second fasteners coupling with the first fasteners of the cap portion, wherein the second fasteners comprise snaps;

each of lower surfaces of the cover members having a plurality of third fasteners being positioned towards each corner of the cover members inwardly of the second fasteners; and each of upper surfaces of the cover members having a plurality of fourth fasteners being positioned towards each corner of the cover members, the fourth fasteners of one cover member coupling with the third fasteners of another cover member, wherein the third and fourth fasteners comprise hooks and loops fasteners.

2. A new therapeutic headpiece for applying a mechanic load to an upper thoracic spine to achieve bone development comprising, in combination:

a cap portion dimensioned for receiving a user's head therein wherein the cap portion includes an open lower end for receiving the user's head and a curved upper portion for contouring to the user's head, the curved upper portion including a forward section, a rearward section, and a pair of opposed side sections;

a plurality of sleeves secured to the cap portion, each of the sleeves having open opposed ends, the open opposed ends for receiving weights therethrough for positioning within the sleeves; and a cover member having an upper surface, and a lower surface dimensioned for resting on the curved upper portion of the cap portion, the upper surface of the cover member having a plurality of circularly arranged tubular sleeves thereon for receiving generally tubular weights therein.

3. The therapeutic headpiece of claim 2, wherein the sleeves are contoured to correspond with the curved upper portion and the head of the user.

4. The therapeutic headpiece of claim 3, wherein the sleeves are latitudinally oriented.

5. The therapeutic headpiece of claim 2, further including a pair of pockets disposed on a forward section and a rearward section of the curved upper portion of the cap portion, each of the pockets having an open upper end for receiving a weight therein, the open upper ends having a flap closably disposed thereover.

6. The therapeutic headpiece of claim 2, wherein the upper portion of the cap portion has a plurality of first fasteners being coupled thereto towards the open lower end, the cover member having a plurality of second fasteners for coupling with the first fasteners of the cap portion.

7. The therapeutic headpiece of claim 2, further comprising a plurality of cover members, wherein the lower surface of each of the cover members is adapted for resting on the upper surface of another cover member.

8. The therapeutic headpiece of claim 7, wherein each of the lower surfaces of the cover members has a plurality of third fasteners, each of upper surfaces the cover members having a plurality of fourth fasteners, the fourth fasteners of one cover member coupling with the third fasteners of another cover member.

* * * * *